US006712906B2

(12) United States Patent
Estelle et al.

(10) Patent No.: US 6,712,906 B2
(45) Date of Patent: Mar. 30, 2004

(54) CONTROL SYSTEM FOR METERING PUMP AND METHOD

(75) Inventors: Peter W. Estelle, Norcross, GA (US); Laurence B. Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/337,463

(22) Filed: Jan. 7, 2003

(65) Prior Publication Data

US 2003/0101931 A1 Jun. 5, 2003

Related U.S. Application Data

(62) Division of application No. 09/702,427, filed on Oct. 31, 2000, now Pat. No. 6,517,891.

(51) Int. Cl.[7] ..... B05C 5/02

(52) U.S. Cl. ..... 118/683; 118/684; 118/686; 118/324; 118/663; 222/63; 156/578

(58) Field of Search ..... 118/683, 684, 118/686, 324, 663; 427/8, 421, 424; 222/63; 156/578

(56) References Cited

U.S. PATENT DOCUMENTS

| | | | | |
|---|---|---|---|---|
| 4,530,862 A | | 7/1985 | Kerzel | 427/422 |
| RE35,010 E | | 8/1995 | Price | 221/1 |
| 5,458,291 A | | 10/1995 | Brusko et al. | 239/423 |
| 5,687,092 A | | 11/1997 | Bretmersky et al. | 702/100 |
| 5,718,767 A | | 2/1998 | Crum et al. | 118/669 |
| 6,613,150 B1 | * | 9/2003 | Calvert et al. | 118/681 |

* cited by examiner

*Primary Examiner*—Laura Edwards
(74) *Attorney, Agent, or Firm*—Wood, Herron & Evans, L.L.P.

(57) ABSTRACT

An apparatus for controlling a speed of a motor of a metering pump providing pressurized fluid at a dispensing gun. The dispensing gun is opened and closed to dispense fluid onto a substrate being carried by a conveyor past the dispensing gun. The apparatus has a pressure control producing first motor speed signals as a function of changing speeds of the conveyor and changing fluid pressures in the dispensing gun when the dispensing gun is open. A flow control produces second motor speed signals as a function of the changing speeds of the conveyor. During changes in conveyor velocity, a motor speed control provides the first motor speed signal to the pump motor which operates the motor at speeds causing the pump to provide fluid to the dispensing gun at pressures changing at a rate tracking a rate of change of the speed of the conveyor. When full conveyor speed is detected, the motor speed control provides the second motor speed signal to the pump motor which operates the motor at speeds determined by the full conveyor speed. In addition, there are methods for generating pressure related and conveyor speed related motor speed signals and automatically switching between those signals as a function of the conveyor speed.

18 Claims, 8 Drawing Sheets

CONTROL SYSTEM FOR METERING PUMP AND METHOD

This application is a Divisional application of U.S. Ser. No. 09/702,427, entitled "Control System for Metering Pump and Method", filed Oct. 31, 2000, now U.S. Pat. No. 6,517,891 hereby expressly incorporated by reference herein.

FIELD OF THE INVENTION

The present invention relates generally to an apparatus for dispensing viscous fluids and, more particularly, to an apparatus and method for supplying hot melt adhesives to a dispensing gun.

BACKGROUND OF THE INVENTION

The ability to precisely dispense viscous industrial materials, such as hot melt adhesives, is a necessity for manufacturers engaged in the packaging and plastics industries. Inconsistent application of adhesive onto a substrate translates into unusable and scrap product and increased costs. Therefore, the process of supplying adhesive to a fluid dispensing applicator or gun must be precisely controlled.

A typical fluid dispensing operation employs a dispensing gun to apply a fluid, for example, an adhesive, onto a substrate being moved past the dispensing gun by a conveyor. The speed of the conveyor, or line speed, is set according to such factors as the complexity of the dispensing pattern and the configuration of the gun. Fluid adhesive is normally supplied to the dispensing gun by flexible hoses. Adhesive is pumped from a reservoir by a metering pump, for example, a motor-driven positive displacement pump. A metering pump for purposes herein is a pump in which the output volume is directly proportional to the action or displacement of the pump independent of fluid viscosity, except for any fluid leakage within the pump. Therefore, with a metering pump, the flow rate of the adhesive being dispensed from the gun is a function of the speed of the motor driving the pump.

The proper application of fluid or adhesive onto a substrate requires that the flowrate of the fluid from the dispensing gun remain as constant as possible throughout the fluid dispensing process. Variations in the flowrate result in different quantities or volumes of fluid being applied at different locations across the substrate. Thus, with too little adhesive, a desired coating thickness is not achieved, and the quality of the adhesive capability is reduced. Similarly, with an excessive quantity of fluid being dispensed, the adhesive may subsequently be displaced to areas of the substrate where it is not wanted; and again, the quality of the substrate product is reduced. In either event scrap product is often the result.

In many applications, the speed of the conveyor carrying the substrate is controllable and changed in accordance with the production line's capability to produce a high quality product. For example, with a first time run of a product, a production line may be operated at a slower speed to ensure a high quality product. But over time, as the production line is tuned, it can operate at a higher conveyor speed and still produce a high quality product. Assume the fluid dispensing system is operating properly with the conveyor operating at a first constant speed. If the speed of the conveyor and the substrate is increased to a higher constant speed, the flowrate of fluid being dispensed through the gun must also be increased in order to maintain a consistent, high quality coating of fluid on the substrate. It is known to use a signal related to the conveyor speed to modify the speed of the pump motor. Hence, when the conveyor is adjusted to the higher constant speed, the speed of the pump motor increases; and the flow of fluid to the gun is increased, thereby causing the pressure within the gun to increase. The increased gun pressure causes the flowrate of fluid from the gun to increase, and thus, the flowrate of the fluid being dispensed is changed as a function of conveyor speed.

The above flow control system works relatively well while the conveyor is operating at a constant speed, however, the flow control system does not operate properly during periods when the conveyor is accelerating or decelerating. Such conveyor speed changes occur, for example, when the conveyor is initially started from rest. Known systems are unable to maintain the desired flowrate of the fluid through the dispensing gun during periods of conveyor acceleration and deceleration.

FIG. 5A illustrates how the fluid pressure at the dispensing gun changes with respect to an acceleration and deceleration of the conveyor. When the conveyor is at a zero speed (500), with some systems, for example, those using a pressure relief recirculation valve, the recirculation pressure is higher (502) than a desired operating pressure (504) of the dispensing gun. Therefore, when the conveyor line is initially started (506) and is accelerating, the fluid dispensing occurs at an excessive pressure, thereby depositing excessive fluid and producing scrap product. The production of scrap product will continue as the pressure decreases (508) and the conveyor accelerates until both the conveyor speed and operating pressure reach their desired values (509). For purposes of illustration, the desired values of conveyor speed and operating pressure are shown as the common line (504). Upon being given a deceleration command (530), the conveyor speed decreases (532) to a zero velocity (534). However, upon the dispensing gun closing, the pressure rises (536) until the pressure relief valve opens and stabilizes the pressure (538).

In other recirculation systems, a solenoid actuated pressure relief valve is in series with a restricted orifice; and upon the recirculation valve opening, the recirculation pressure (510) is held at a level lower than desired operating pressure. Upon the conveyor accelerating (506), the gun pressure initially drops to a still lower pressure (512) faster than the metering pump can increase the pressure. Therefore, for a short period of time after the conveyor line starts, an excessive amount of fluid is dispensed which results in the production of scrap product. As the conveyor line accelerates, at some point (514), for a current conveyor speed, the correct amount of fluid is being dispensed; but continued conveyor line acceleration (516) with lower pressure (518) results in less than the desired flowrate of fluid through the dispensing gun. Thus, scrap product continues to be produced until the conveyor speed and operating pressure both reach their desired values (504). Upon the conveyor starting a deceleration, the recirculation valve is opened and the pressure decreases until it is stabilized at a value (542) determined by the restricted orifice.

As can be seen in FIG. 5A, with the lower recirculation pressure just described, the conveyor accelerates to its desired speed well before the dispensing gun pressure reaches its desired operating pressure. A significant contributing factor to this extended pressure recovery time is the use of flexible hoses connecting the pump with the dispensing gun. At the desired operating pressure, the hoses expand slightly; and the quantity of fluid being dispensed is small relative to the volume of the hoses. In fact, many times, the quantity of fluid dispensed is no more, and often less, than the expansion, or increased volume, of the hose at the desired operating pressure. Therefore, it takes longer for the pump to restore the desired gun pressure because the pumped fluid has to again expand the hose with fluid in order to achieve the desired operating pressure. As will be appreciated, the graphical representations of the pressure and line speed in FIG. 5 are only exemplary. The acceleration and deceleration of the conveyor often varies nonlinearly and normally is not linear as shown. Further, the acceleration and deceleration of the conveyor may differ from day to day and may be different with different systems. Further, the the exact profile of pressure with respect to time often varies substantially on an instantaneous basis and is not in any respect related to the conveyor speed.

Therefore, there is a heed for a fluid dispensing system which maintains a desired flowrate of fluid through the dispensing gun while the speed of the conveyor carrying the substrate is changing, for example, when the conveyor is accelerating from rest to its desired conveying speed.

SUMMARY OF THE INVENTION

The fluid dispensing system of the present invention addresses the above and other problems associated with known systems in providing a system for pumping a fluid to a dispensing gun. The fluid dispensing system of the present invention minimizes the production of scrap product during periods of changing conveyor speed. The fluid dispensing system of the present invention is especially useful at the beginning of a production run when the conveyor is accelerating from rest to a desired full production speed. In addition, the fluid dispensing system provides the same benefits at the end of a production run when the conveyor is decelerating from its full production speed to rest. Thus, by reducing scrap production, the fluid dispensing system of the present invention reduces scrap product, maintenance, and the product unit cost.

In accordance with the principles of the present invention and the described embodiments, the invention in one embodiment provides an apparatus for controlling a speed of a motor of a metering pump providing pressurized fluid at a dispensing gun. The dispensing gun is opened and closed to dispense fluid onto a substrate being carried by a conveyor past the dispensing gun. The apparatus has a pressure control producing first motor speed signals as a function of changing speeds of the conveyor and changing pressures of the fluid in the dispensing gun when the dispensing gun is open. A flow control produces second motor speed signals as a function of the changing speeds of the conveyor. A motor control responds automatically to the first and second motor speed signals to produce speed command signals for the motor. The speed command signals operate the motor at speeds causing the pump to provide fluid to the dispensing gun at pressures changing at a rate tracking a rate of change of the speed of the conveyor.

The first motor speed signal from the pressure control operates the pump motor in response to both conveyor speed and fluid pressure at the dispensing gun during an acceleration or deceleration of the conveyor. Thus, the pressure at the dispensing gun changes at a rate that follows the acceleration and deceleration of the conveyor, and the flow of fluid from the dispenser also follows the acceleration and deceleration of the conveyor to dispense the proper amount of fluid on the substrate. When the conveyor reaches a constant full speed, the motor control provides the second motor speed signal to the pump motor, thereby controlling flow of the fluid in accordance with the constant full conveyor speed.

In another embodiment, the invention includes a method of providing fluid under pressure to a dispensing gun with a metering pump connected to a motor. The dispensing gun opened and closed to dispense fluid onto a substrate being carried by a conveyor past the dispensing gun. First, a speed of the conveyor is changed. Then, fluid pressures at the dispensing gun are detected while the speed of the conveyor is changing and the dispensing gun is dispensing fluid. In addition, speeds of the conveyor are detected while the speed of the conveyor is changing. In response to detecting the pressures and the speeds, the fluid pressures at the dispensing gun are changed at a rate substantially tracking a rate of change of the speed of the conveyor. Thereafter, the flow of the fluid is automatically controlled as a function of detecting a full speed of the conveyor.

In one aspect of the invention, first motor speed signals are generated in response to the detected fluid pressures and conveyor speeds, and a second motor speed signal is generated in response to detecting a full conveyor speeds. The control of motor speed is automatically switched from the first motor speed signals to the second motor speed signal in response to conveyor having the full conveyor speed.

In a further aspect of the invention, control of the motor speed is gradually switched from the first motor speed signals to the second motor speed signal utilizing differing proportions of the first and second motor speed signals.

The above and other objects and advantages of the present invention shall be made apparent from the accompanying drawings and the description thereof.

BRIEF DESCRIPTION OF THE DRAWINGS

The accompanying drawing, which is incorporated in and constitutes a part of this specification, illustrates embodiments of the invention and, together with a general description of the invention given above, and the detailed description of the embodiments given below, serves to explain the principles of the invention.

DETAILED DESCRIPTION OF THE INVENTION

Figure 1:
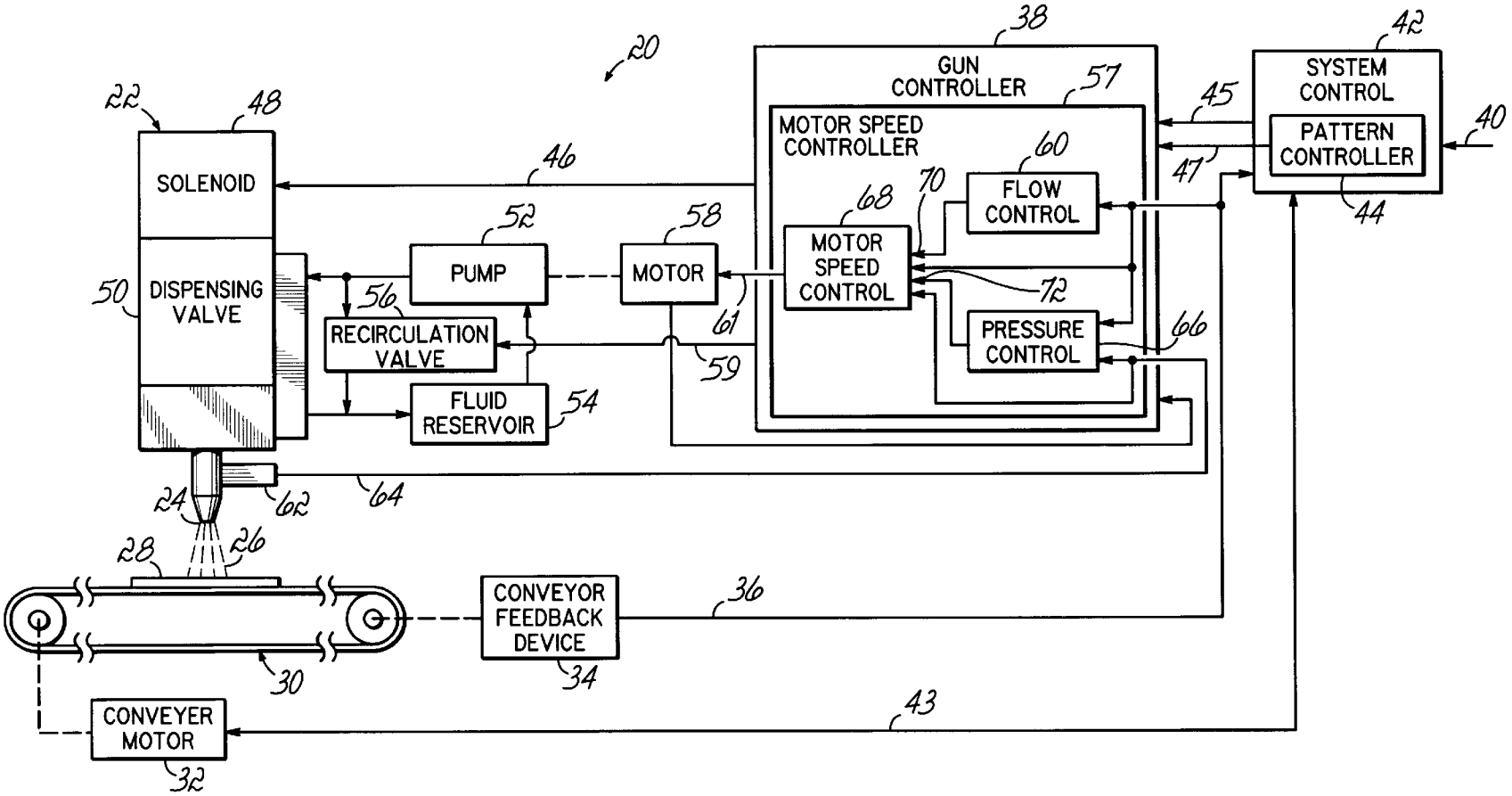
FIG. 1 is an overall schematic block diagram of a fluid dispensing system in accordance with the principles of the invention.

Referring to FIG. 1, a fluid dispensing system is comprised of a fluid dispensing gun 22 having a nozzle 24 for dispensing a fluid 26, for example, an adhesive, onto a substrate 28. The substrate 28 is carried by a conveyor 30 past the dispensing gun 22. The conveyor 30 is mechanically coupled to a conveyor drive having a conveyor motor 32. The speed of the conveyor is detected by a conveyor feedback device 34, for example, an encoder, mechanically coupled to the conveyor 30. The feedback device 34 has an output 36 connected to a dispensing gun controller 38, and the feedback device 34 provides a feedback signal that changes as a function of changes in the conveyor speed.

A system control 42 generally functions to coordinate the operation of the overall fluid dispensing system. For example, the system control 42 normally provides a user interface for the system and controls the operation of the conveyor motor 32 via signal line 43. Further, within the system control 42 is a pattern controller 44 that controls the operation of the fluid dispensing gun 22 as a function of the particular application being run. The pattern controller 44 receives, on input 40, a part present or trigger signal that provides a synchronization with motion of the substrate 28 on the moving conveyor 30. In response to the trigger signal on an input 40 of a system control 42, the system control provides a first signal to the gun controller 38 via an input 45 requesting the gun controller to close a recirculation valve 56. The recirculation valve 56 is used to shunt fluid from the metering pump 52 around the dispensing valve 50 and back to the reservoir 54 during idle periods, for example, between parts. Further, in response to the trigger signal, the pattern controller 44 provides a sequence of gun ON/OFF signals normally in the form of pulses to the gun controller 38 via an input 47.

The gun controller 38 provides output signals to operate the dispensing gun 22 as a function of the timing and duration of the gun ON/OFF signals from the pattern controller 44. In response to the leading edge of the gun ON/OFF pulse, the gun controller 38 provides a gun command on an output 46 that operates a solenoid 48 within the dispensing gun 22. The solenoid 48 is mechanically coupled to a dispensing valve 50 that is fluidly connected to a metering pump 52 that, in turn, receives fluid from a fluid reservoir 54. Upon receiving a signal on output 46 from the gun controller 38, the solenoid 48 opens the dispensing valve 50. The pressurized adhesive in the dispensing gun passes through the nozzle 24 and is deposited onto the substrate 28. The dispensing valve remains open for the duration of the gun ON/OFF pulse; and in response to the trailing edge of a gun ON/OFF pulse, the gun controller changes the state of the solenoid 48 to close the dispensing valve 50. In most applications, as the substrate 28 is moved past the dispensing gun 22, a plurality of gun ON/OFF pulses cause the gun controller to rapidly open and close the dispensing valve to deposit the fluid at different locations on the substrate.

The pump 52 is a positive displacement pump; and therefore, over a dispensing time period, the volume of fluid supplied to the dispensing valve 50 and dispensed through the nozzle 24 is directly proportional to the speed of the pump motor 58. A motor speed controller 57 within the gun controller 38 is responsive to the conveyor feedback device 34 and a pressure feedback device 62 for providing motor speed command signals on an output 61 to the pump motor 58. A flow control 60 within the motor speed controller 57 is responsive to the feedback signal from the feedback device 34 to provide a motor-speed-dependent-on-line-speed ("$MS_{LS}$") motor speed signal. The $MS_{LS}$ signal is provided by the motor speed control 68 over a signal line 61 to the pump motor 58. The $MS_{LS}$ signal changes as a function of the line speed of the conveyor 30; and thus, the pump motor 58 is controlled to have a speed that is related to the speed of the conveyor 30. Consequently, the flow of fluid through the dispensing valve 50 changes as a function of changes in the conveyor speed.

As previously described, such a line speed control system has certain disadvantages during periods of acceleration and deceleration of the conveyor. Therefore, the present invention utilizes a pressure transducer 62 that detects pressure at a point immediately upstream of the dispensing nozzle 24. A pressure control 66 provides a motor-speed-dependent-on-pressure ("$MS_P$") motor speed signal in response to the feedback signal from the feedback device 34 and a pressure feedback signal on an output 64. The motor speed control 68 switches control of the pump motor 58 between the $MS_{LS}$ signal on an input 70 and the $MS_P$ signal on an input 72. Essentially, at the beginning of an acceleration or deceleration period, the motor speed selector 68 controls the pump motor 58 as a function of dispensing gun fluid pressure, that is, the $MS_P$ signal from the pressure control 66. When the dispensing gun pressure is equal to the desired operating pressure with the conveyor at full line speed, the motor speed selector 68 switches control of the pump motor 58 from a pressure control to a flow control using the $MS_{LS}$ signal from the control 60.

Figure 2A:
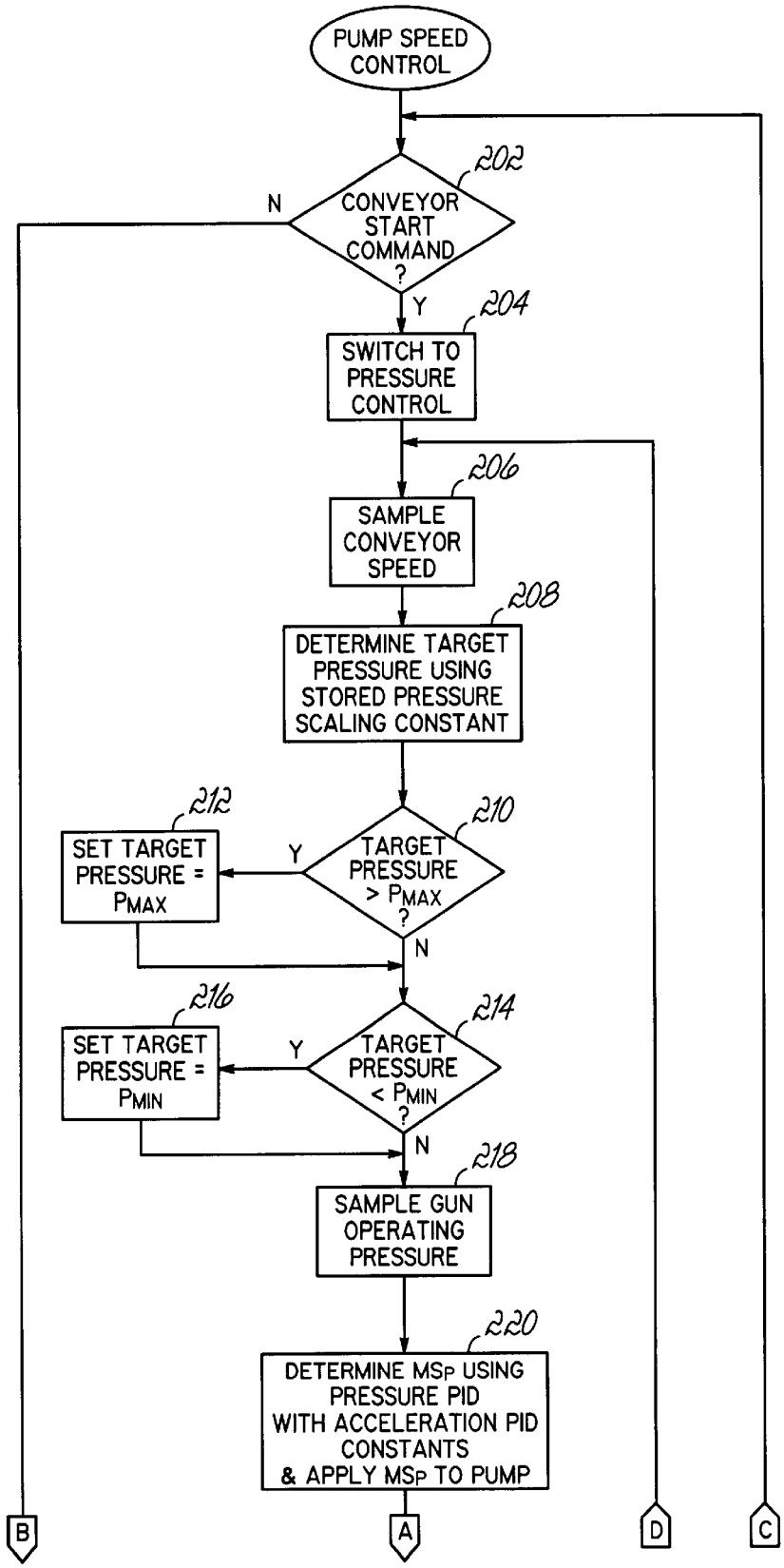
FIGS. 2A–2B are flowcharts illustrating one embodiment of a process for controlling pump motor speed for the fluid dispensing system of FIG. 1.
Figure 2B:
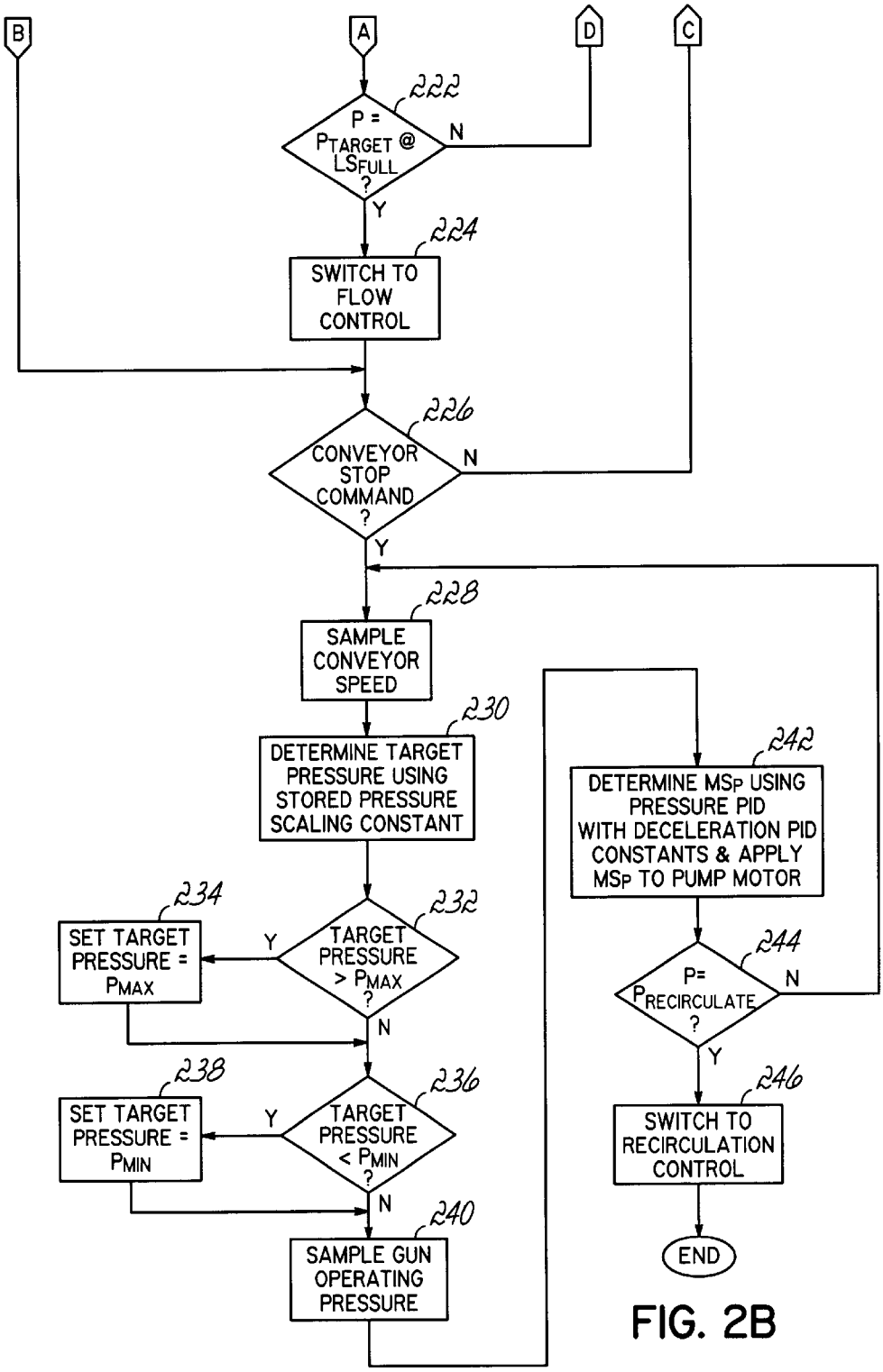

One embodiment of such an operation of the gun controller 38 is illustrated by the flowchart of FIGS. 2A and 2B. Upon initially starting a fluid dispensing system as illustrated in FIG. 1, the pump motor 58 is started before the conveyor motor 32 in order to initially stabilize and pressurize the fluid system comprised of the pump 52, recirculation valve 56 and fluid reservoir 54. The motor 58 is operated at a constant recirculation speed such that a known pressure is provided at the output of the pump 52. The pressure may be created by the recirculation valve 56 being a pressure relief valve. Alternatively, the recirculation valve 56 may be a solenoid valve having a serially connected restricted orifice that provides the desired pressure drop. The pressure at the output of the pump 52 may be higher or lower than the normal operating pressure detected by the transducer 62 immediately upstream of the nozzle 24.

In providing a better control of the speed of the pump motor 58, the gun controller 38 first, at 202 of FIG. 2A, determines whether a conveyor start command has been given by the system control 42 to the conveyor motor 32. A signal representing the start of the conveyor line is also provided to the gun controller 38 by the system control 42. The gun controller 38, at 204, switches to pressure control of the pump motor 58 and ends the recirculation control. To end recirculation control, the controller 38 provides a signal over an output 59 causing the recirculation valve 56 to close, thereby terminating the recirculation mode. This step is necessary if the recirculation path includes a solenoid valve. If the recirculation valve is provided by a pressure relief valve, the recirculation mode is terminated by a lesser pressure differential across the relief valve caused by the dispensing valve opening. Thereafter, at 206, the gun controller 38 samples the feedback signal from the conveyor encoder 34 representing the conveyor speed. The controller 38, at 208, then multiplies the recently sampled conveyor speed times a stored pressure scaling constant to determine a target pressure value or setpoint. The stored pressure scaling constant is a fraction having a numerator equal to the desired dispensing pressure and a denominator equal to the full line speed. Thereafter, at 210, the controller 38 determines whether the target pressure value is greater than a maximum pressure limit, for example, 1500 pounds per square inch (psi); and if it is, the target pressure, at 212, is set equal to the maximum pressure limit. The controller 38 then determines whether the target pressure value is less than a minimum pressure limit, for example, 25 psi; and if so, at 216, the target pressure is set to a value equal to the minimum pressure limit.

The controller then, at 218, samples a pressure feedback signal provided from output 64 of the pressure transducer 62. The pressure control 66 within the controller 38, at 220, determines a value for $MS_P$ using the target pressure and the sampled gun operating pressure in a known PID process with acceleration PID constants. With the PID process, depending on the application and desired response, proportional and/or integral and/or derivative terms are determined from the pressure values, and each of the terms has a gain or multiplier that is in the range of from zero to a value that is empirically determined to provide the desired response and stability to the operation of the motor 58 of the pump 52. At the initiation of a conveyor acceleration cycle, the motor speed selector 68 applies the $MS_P$ signal to the pump motor 58.

Figure 5A:
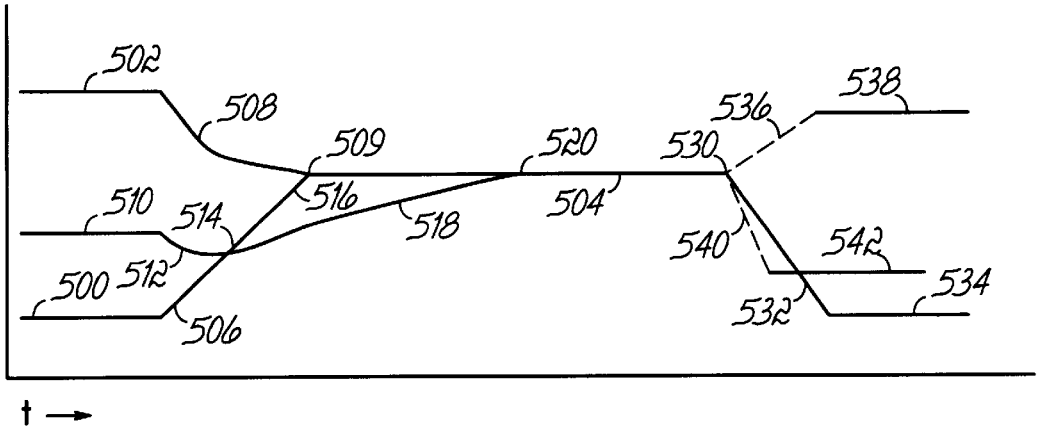
FIG. 5A is a graphical illustration of known relationships of conveyor speed and fluid dispenser pressure with respect to time.
Figure 5B:
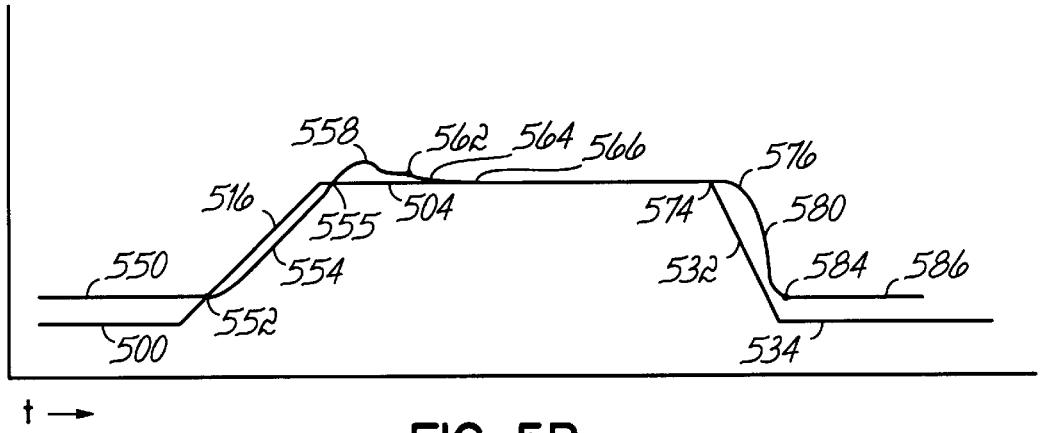
FIG. 5B is a graphical illustration of a new relationship of fluid dispenser pressure with respect to time when using the fluid dispensing system of FIG. 1.

The results of utilizing pressure as a pump motor control signal is illustrated in FIG. 5B. As can be seen with this embodiment, the recirculation pressure (550) is less than with prior systems. Further, when the line speed provides a target pressure value equal to the recirculation pressure (552), the controller 38 provides a signal over output 59 to close the recirculation valve 56. Simultaneously, the controller 38 provides a signal over output 46 to cause the solenoid 48 to open the dispensing valve 50. The pressure control 66 provides an $MS_P$ signal to the pump motor 58, so that changes in the dispensing gun pressure (554) follow changes in the conveyor speed (516) with respect to time. To provide a desired response, the PID constants are set such that the pressure (558) slightly overshoots the full line speed (504). It should be noted that the desired response will differ with different applications and designers. The pressure curve in FIG. 5B at 558 is shown as being slightly underdamped; however, as will be appreciated, the PID process can be adjusted to provide a more critically damped pressure function or even an overdamped pressure function.

The controller 38 then, at 222 (FIG. 2B), determines whether the operating gun pressure is equal to the target pressure at full line speed. The point at which the pressure intersects the constant line speed at 555 is theoretically the ideal pressure to be detected. However, for many reasons, for example, the target pressure is determined from a scaling constant based on noncurrent values, the detection of the pressure at 555 is very difficult. Thus, applicants have chosen to detect when the operating gun pressure has stabilized and thus, has a substantially zero slope for some period of time. As will be appreciated, other methods of detecting pressure at full line speed may be employed. Upon detecting the target pressure at full line speed (562 of FIG. 5B), motor speed controller 57 at 224 switches to flow control the pump motor 58. Thus, the motor speed control 68 within the motor speed controller 57 switches control of the pump motor 58 from the $MS_P$ motor speed signal to the $MS_{LS}$ motor speed signal. At this point, the control of the pressure within the dispensing gun 22 transitions (564) from the switch point (562) to a flow control (566) determined by the full line speed of the conveyor.

During the time that the conveyor is operating at full line speed, the speed of the pump motor 58 is controlled by the gun controller 38 as a function of the conveyor feedback signal in a known manner. The flow control continues until the controller 38, at 226 (FIG. 2B), determines whether a conveyor stop command has been issued by the system control 42. As with the acceleration mode, controlling the speed of the pump motor 58 with the conveyor feedback signal does not take into account the variations in pressure arising from the fluid dispensing process in a deceleration mode. Therefore, the motor speed selector 68 within the gun controller 38 switches control of the pump motor 58 from the flow control 60 to the pressure control 66. Once again, a conveyor speed is sampled at 228, and a target pressure determined, at 230, in a the same manner as previously described. Also, as previously described, the target pressure is checked against maximum and minimum limits at 232–238. The gun pressure is again sampled at 240. A motor speed value ($MS_P$) is determined, at 242, by the controller 38 using the target pressure and the sampled pressure in a PID loop with deceleration PID constants; and the $MS_P$ value is applied to the pump motor 58. The gun controller 38 then at 244 detects from the pressure feedback signal on line 64 when the dispensing gun pressure is equal to the desired recirculation pressure. When the recirculation pressure is achieved, the gun controller 38, at 246, switches to recirculation control of the pump motor 58. The controller 38 provides a first signal over line 61 commanding the pump motor 58 to operate at a recirculation speed and a second signal over line 59 commanding the recirculation valve to open. Thereafter, the system control 42 stops the operation of the conveyor motor at the end of the deceleration cycle.

Again, referring to FIG. 5B, upon starting a deceleration (574), the pressure (576) results from control of the pump motor 58 being switched to the pressure control 66. Changes in the dispensing gun pressure (580) generally follow changes in the slowing conveyor line speed (532) so that the proper amount of fluid is supplied by the pump 52 to the dispensing gun 22 and dispensed on the substrate 28. Upon reaching the recirculation pressure, the recirculation valve 56 is opened; and the pump motor is operated at the recirculation speed, thereby stabilizing the recirculation pressure. The conveyor comes to rest at a zero velocity (534).

The above system provides a substantially improved relationship of dispensing gun pressure with respect to conveyor line speed during periods of acceleration and deceleration of the conveyor 30. With the above system, when the conveyor is accelerating or decelerating, a pressure control system is active in which the motor pump speed is under the control of a pressure loop that causes a rate of change in fluid pressure at the gun to follow or track a rate of change in the conveyor speed. However, when the conveyor reaches a full speed condition, control of the pump motor is switched from a pressure control system to a flow control system in which the pump motor speed is controlled exclusively as a function of the conveyor line speed. Such a system is effective in different applications and on different systems where the acceleration and deceleration of the conveyor will vary. Further, with the dispensing system of the present invention, the dispensing of fluid onto the substrate 28 during periods of acceleration and deceleration is within specification; and scrap product is eliminated.

However, there is a disadvantage to the operating process described with respect to FIGS. 2A and 2B. Referring to FIG. 5B, control of the pump motor 58 is switched from the pressure control 66 to the flow control 60 at a point in time (562). However, at the switching point (562), the motor speed resulting from operation of the pressure control 66 is different from the motor speed resulting from the operation of the flow control 60. Therefore, the system attempts to provide an instantaneous motor speed change equal to that difference. Such an abrupt switch in motor speed can result in an erratic or jerky operation of the pump motor 58 which creates mechanical stresses on the motor and pump as well as pressure irregularities and inconsistent fluid dispensing within the dispensing gun 22.

Figure 3A:
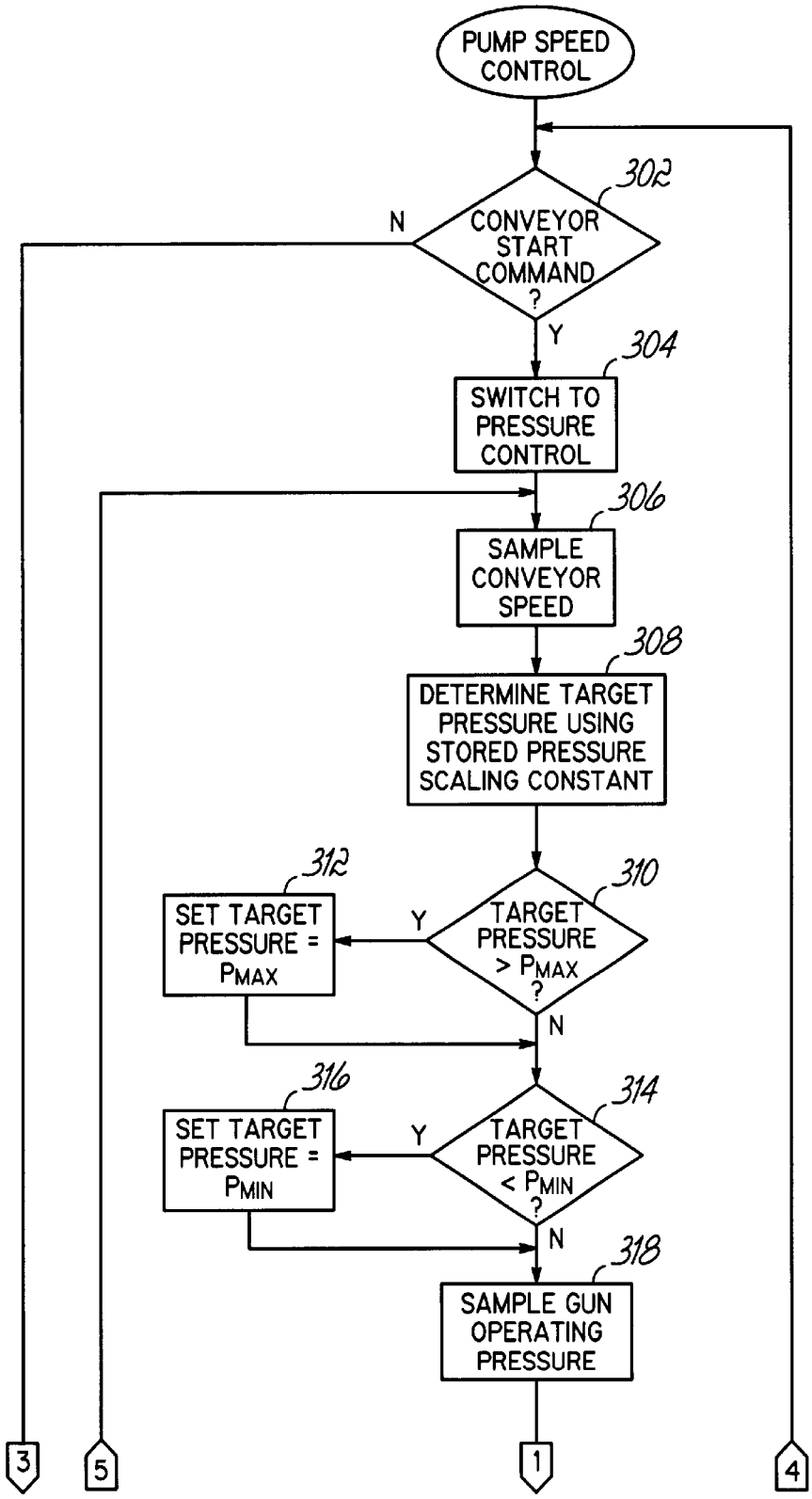
FIGS. 3A–3C are flowcharts illustrating another embodiment of a process for controlling pump motor speed for the fluid dispensing system of FIG. 1.
Figure 3B:
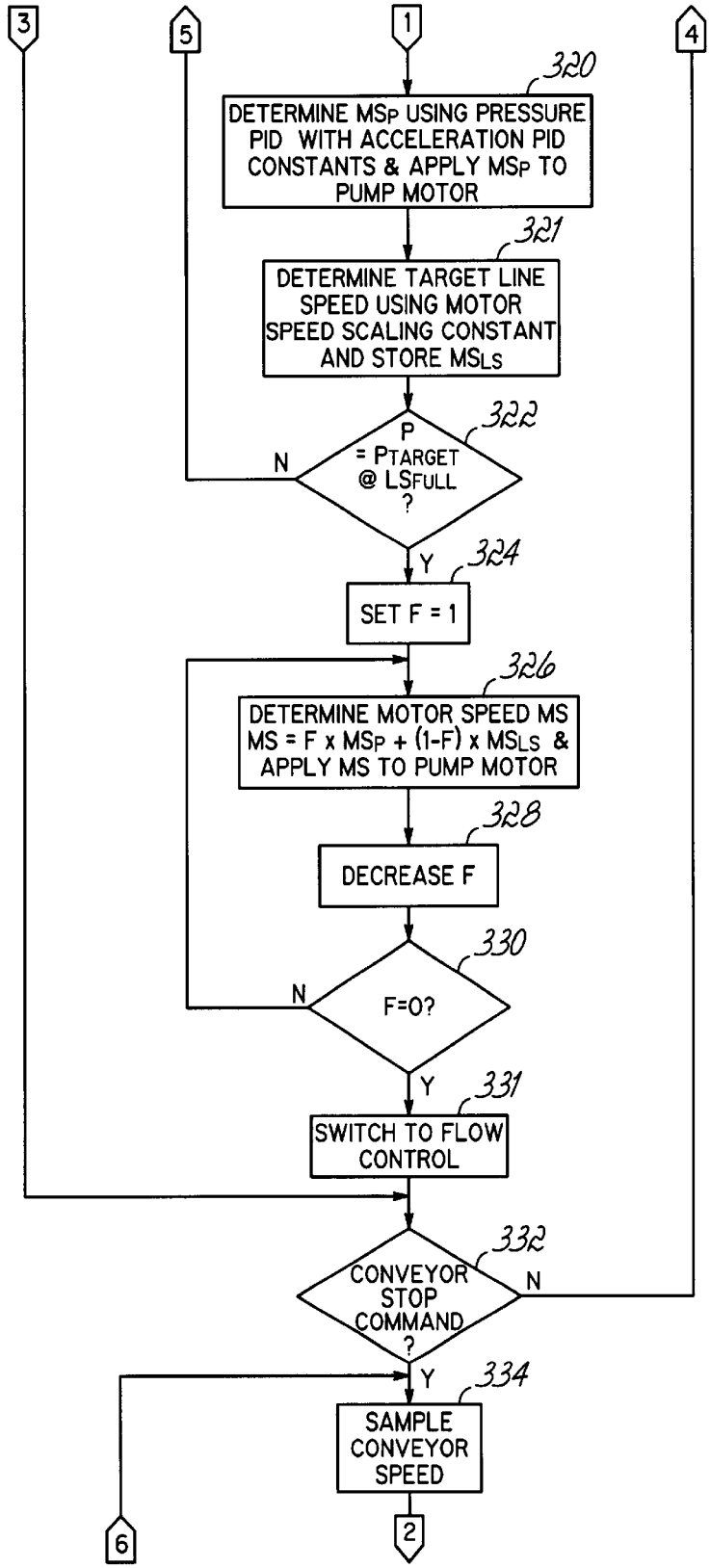
Figure 3C:
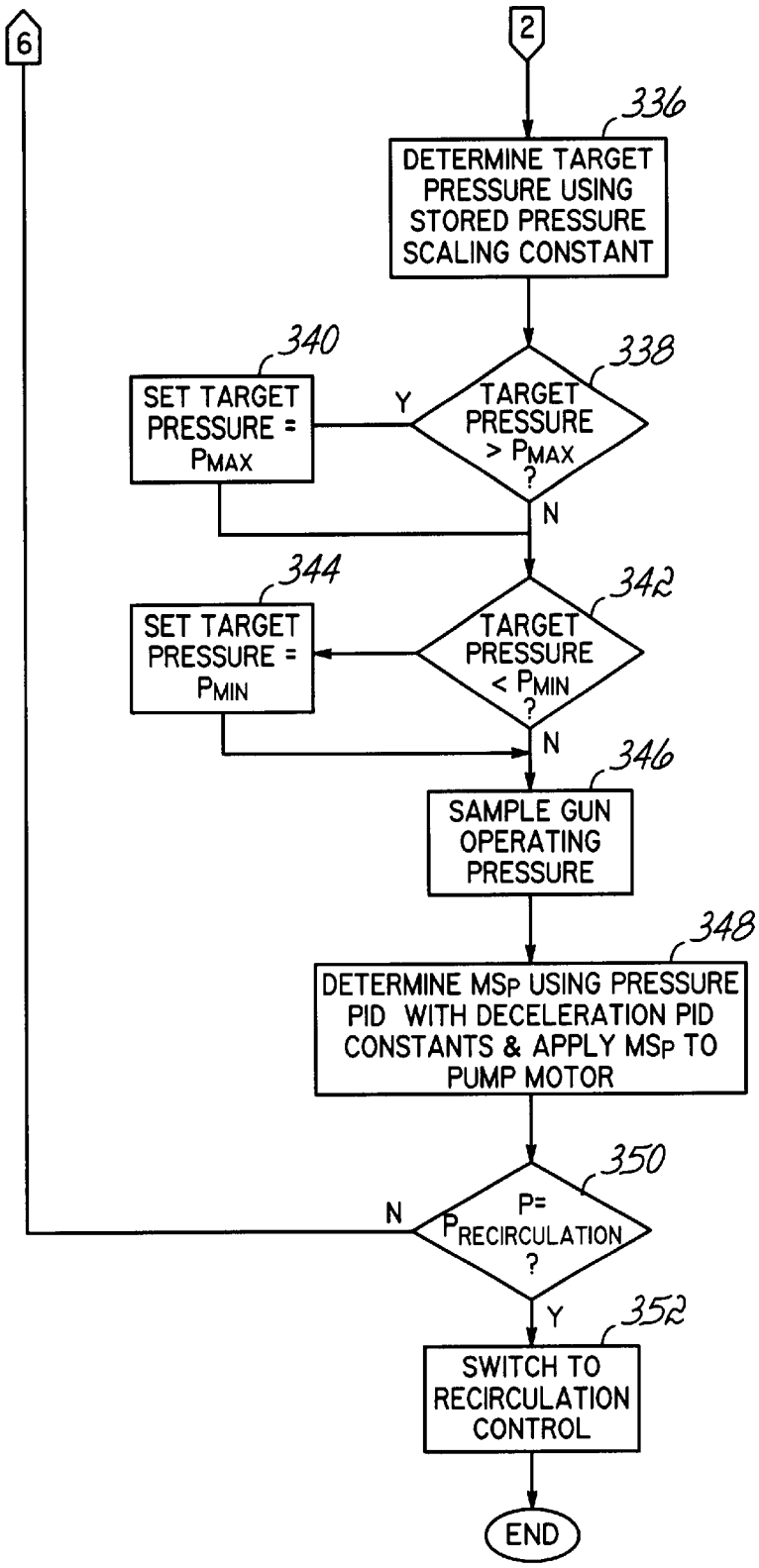

FIGS. 3A–3C illustrate an alternative embodiment of the invention in which the transition between pressure control of the pump motor 58 and line speed control of the pump motor 58 is gradual and controlled. In this embodiment, the operation of process steps 302–320 are identical to the operation of process steps 202–220 previously described with respect to FIGS. 2A–2B. Referring to FIG. 3B, the controller 38, at 321, also determines a target line speed value or setpoint by multiplying the current value of the conveyor speed times a motor speed scaling constant. The motor speed scaling constant is a fraction having a numerator equal to the full speed of the pump motor 58 and a denominator equal to the full line speed of a conveyor 30. The product of the most recently sampled conveyor line speed times the motor speed scaling constant is stored by the controller 38 as an $MS_{LS}$ value.

Again, as previously described with respect to FIG. 2, the motor speed selector 68 within the motor speed controller 57 determines, at 322, whether the current dispensing gun pressure is equal to the target pressure at full scale line speed. When that switching point is detected, the motor speed selector 68 then gradually shifts control of the speed of the pump motor 58 from the pressure control 66 to the flow control 60. That shift in control can be performed linearly or nonlinearly with time. Further, the incremental resolution of each step in the transition is selectable in accordance with a particular the application, user preferences, etc. The motor speed selector 68 first, at 324, sets a transition constant F equal to 1. Thereafter, at 326, the mode speed selector 68 determines a first increment of the transition in accordance with the following:

$$MS=F\times MS_P+(1-F)\times MS_{LS},$$

and that value of MS is applied to the pump motor 58. Thereafter, at 328, the motor speed selector decreases the value of F and, at 330, determines whether the value of F equals zero. The process of steps 324–330 is iterated until the value of F equals zero. With each iteration through steps 324–330, F may be fractionally decreased in equal or nonequal increments. Further any number of increments may be used. When F equals zero, the full value of the $MS_{LS}$ motor speed signal is being applied to the pump motor 58, and, at 331, the motor speed control 57 switches to the flow control of the motor 58. Thus, the control of the pump motor 58 is gradually shifted from the pressure control 66 to the flow control 60. Such gradual shifting of control helps to minimize any sudden changes in the motor speed command to the pump motor 58 that may result in abrupt changes in the pressure within the dispensing gun 22, thereby causing sudden changes in the fluid being dispensed.

Thereafter, at 332, the gun controller 38 is provided with an input from the system control 42 indicating that the conveyor 30 has been commanded to stop. In an identical manner as previously described with respect to steps 306–321, the conveyor speed is sampled at 334, a target pressure determined and checked against maximum and minimum limits at 336–344. The gun pressure is then sampled at 346, and a $MS_P$ value determined at 348 and applied to the pump motor. The recirculation pressure is detected at 250; and if the pressure is above the recirculation pressure, the process of steps 334–350 is iterated. The command of the pump motor 58 remains under the control of the pressure control 66 until the recirculation pressure is reached. Thereafter, in a manner as previously described, and the gun controller 38 switches the system back to recirculation control at 352.

Figure 4:
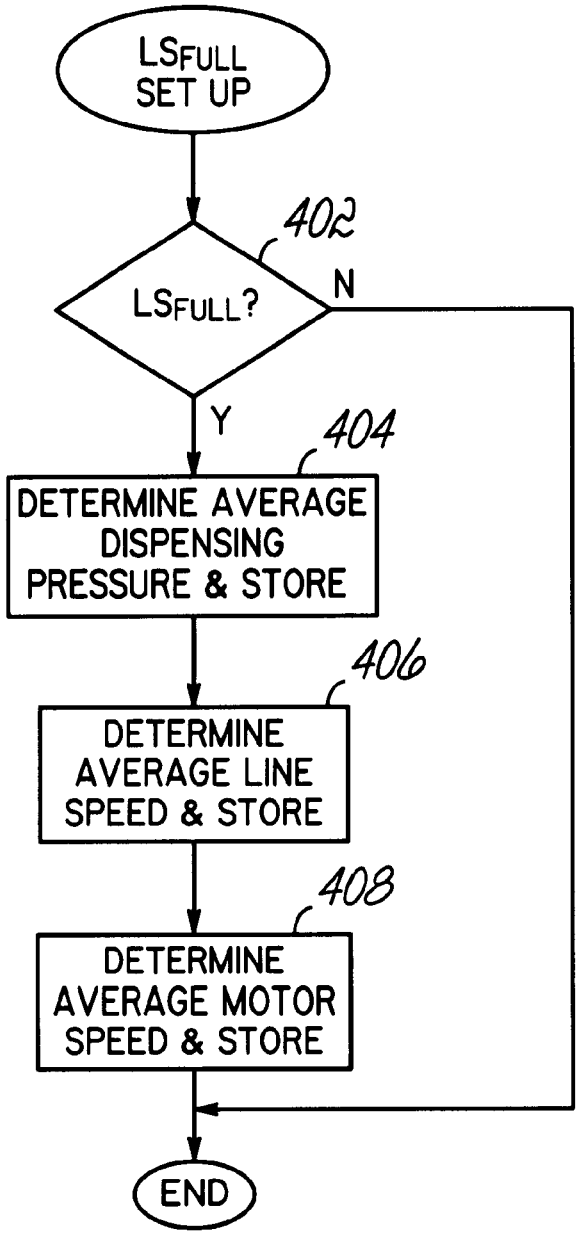
FIG. 4 is a flowchart illustrating a cycle for capturing values of parameters used in the processes of controlling pump motor speed for the fluid dispensing system of FIG. 1.

In the embodiments illustrated in FIGS. 2 and 3, various scaling constants are utilized which are based on full dispensing pressure, full line speed and full motor speed. Those values may be determined in advance and manually entered into the system control 42 and passed to the gun controller 38 for storage. Alternatively, those values may be continuously determined and stored by the gun controller 38. For example, referring to FIG. 4, at 402, the controller 38 first determines when the conveyor has reached its full line speed. Upon detecting full line speed, the gun controller 38 at 404, samples the pressure feedback signal, determines the average dispensing pressure and stores that value. Thereafter, at 406, the controller 38 samples the conveyor feedback signal, determines the average full line speed value and stores that value. At 408, the controller 38 samples a pump motor feedback signal on line 63, determines an average motor speed value and stores that value. The process of FIG. 4 may be executed continuously while the conveyor is running at full line speed so that the stored values always represent the most recent full scale values of dispensing gun pressure, conveyor line speed and pump motor speed. Alternatively, the process of FIG. 4 may be run at selected times during the operation of the conveyor, for example, immediately prior to the conveyor being commanded to stop.

The fluid dispensing system described above permits an accurate deposition of fluid onto the substrate during periods of conveyor acceleration and conveyor deceleration, thereby permitting the production of good product during the full time of conveyor operation. Thus, the fluid dispensing system described above is effective to reduce scrap as well as maintenance and product unit cost.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, in the described embodiments, during periods of changing conveyor speed, a pressure feedback signal is used with a target pressure in a PID process to provide motor speed signals operating the motor at speeds causing fluid pressure changes at the dispensing gun to follow changes in conveyor speed over time. As will be appreciated, fuzzy logic, neural nets, model based systems or other processes and systems may be used to provide a motor speed signal as a function of fluid pressure at the dispensing gun.

The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An apparatus for controlling a speed of a motor of a metering pump providing a pressurized fluid at a dispensing gun, the dispensing gun being opened and closed to dispense fluid onto a substrate being carried by a conveyor past the dispensing gun, the apparatus comprising:

a pressure control producing first motor speed signals as a function of changing speeds of the conveyor and changing pressures of the fluid in the dispensing gun when the dispensing gun is open; and a flow control producing a second motor speed signal as a function of a full speed of the conveyor;

a motor control responding automatically to either said first motor speed signals or said second motor speed signal and producing speed command signals to the motor, said speed command signals operating the motor at speeds causing the pump to provide fluid to the dispensing gun at pressures changing at a rate tracking a rate of change of the speed of the conveyor.

2. An apparatus for controlling a speed of a motor of a metering pump providing a pressurized fluid at a dispensing gun, the dispensing gun being opened and closed to dispense fluid from a nozzle onto a substrate being carried by a conveyor past the dispensing gun, the apparatus comprising:

a motor speed controller operatively connected to the motor of the metering pump and providing one of first motor speed signals in response to detecting changing speeds of the conveyor and changing pressures of the fluid in the dispensing gun when the dispensing gun is open, and a second motor speed signal in response to detecting a full speed of the conveyor, said first and second motor speed signals operating the motor at speeds causing the pump to provide fluid to the dispensing gun at pressures changing at a rate tracking a rate of change of the speed of the conveyor.

3. The apparatus of claim 2 wherein said motor speed controller further comprises:

a first input receiving conveyor feedback signals representing respective speeds of the conveyor; and a second input receiving pressure feedback signals representing respective pressures of the fluid.

4. The apparatus of claim 3 wherein said pressure feedback signals represent respective pressures of the fluid at a point immediately upstream of the nozzle.

5. The apparatus of claim 3 wherein said motor speed controller generates target pressures as a function of the speeds of the conveyor and provides said first motor speed signals as a function of the target pressures and the pressures of the fluid as represented by respective pressure feedback signals.

6. The apparatus of claim 3 wherein said motor speed controller generates each of the target pressures by multiplying one of the speeds of the conveyor times a stored constant, wherein the stored constant represents a fraction having a numerator representing a pressure at the dispensing gun and a denominator representing a conveyor speed.

7. The apparatus of claim 3 wherein said motor speed controller generates each of the target pressures by multiplying one of the speeds of the conveyor times a stored constant, the stored constant representing a fraction having a numerator representing a desired dispensing pressure at the dispensing gun during a dispensing operation and a denominator representing the full speed of the conveyor.

8. The apparatus of claim 3 wherein said motor speed controller generates each of the target pressure by multiplying one of the speeds of the conveyor times a stored constant, the stored constant representing a fraction having a numerator representing a full pressure at the dispensing gun at a full conveyor speed during an immediately prior dispensing operation and a denominator representing the full conveyor speed during the immediately prior dispensing operation.

9. The apparatus of claim 3 wherein said motor speed controller determines said first motor speed signals by utilizing the target pressures and the pressures at the dispensing gun in a proportional, derivative, integral process loop.

10. The apparatus of claim 3 wherein said motor speed controller further comprises:

a pressure control responsive to the conveyor and pressure feedback signals and producing said first motor speed signals as a function of changing speeds of the conveyor and changing pressures of the fluid in the dispensing gun when the dispensing gun is open; and a flow control responsive to said conveyor feedback signal and producing said second motor speed signal as a function of the full speed of the conveyor.

11. The apparatus of claim 10 wherein said motor speed controller further comprises a motor speed control causing said motor speed controller to provide said first motor speed signals in response to detecting a conveyor speed less than a full speed of the conveyor, and said second motor speed signal in response to detecting the full speed of the conveyor.

12. An apparatus for controlling a speed of a motor of a metering pump providing a pressurized fluid at a dispensing gun, the dispensing gun being opened and closed to dispense fluid from a nozzle onto a substrate being carried by a conveyor past the dispensing gun, the apparatus comprising:

a motor speed controller operatively connected to the motor of the metering pump and providing first motor speed signals in response to detecting changing speeds of the conveyor and changing pressures of the fluid in the dispensing gun when the dispensing gun is open, and a second motor speed signal in response to detecting a full speed of the conveyor, said motor speed controller automatically switching control of the speed of the motor between said first motor speed signals and said second motor speed signal, said first and second motor speed signals operating the motor at speeds causing the metering pump to provide fluid to the dispensing gun at pressures changing at a rate tracking a rate of change of the speed of the conveyor.

13. The apparatus of claim 12 wherein said motor speed controller automatically switches control of the speed of the motor by first detecting a target pressure of the fluid at the dispensing gun at the full speed of the conveyor, and then providing said second motor speed signal in response to detecting the target pressure of the fluid at the dispensing gun at the full speed of the conveyor.

14. The apparatus of claim 13 wherein said motor speed controller generates a plurality of motor speed command signals as a function of a combination of said first and second motor speed signals, each successive motor speed command signal being generated with successively smaller portions of said first motor speed signal and successively larger portions of said second motor speed signal.

15. The apparatus of claim 14 wherein said motor speed controller generates initial motor speed command signals as a function of principally said first motor speed signals, then generates successive motor speed command signals as a function of successively smaller portions of said first motor speed signals and successively larger portions of said second motor speed signal, and thereafter generates final motor speed command signals as a function of principally said second motor speed signal.

16. The apparatus of claim 15 wherein said motor speed controller generates motor speed command signals in accordance with $$MS=F\times MS_P+(1-F)\times MS_{LS},$$

where:

MS=a motor speed command, $MS_P$=the first motor speed signal, $MS_{LS}$=the second motor speed signal, and F=a factor that varies incrementally between 0 and 1 with time.

17. The apparatus of claim 10 wherein said motor speed controller further comprises:

a pressure control producing said first motor speed signals as a function of changing speeds of the conveyor and changing pressures of the fluid in the dispensing gun when the dispensing gun is open; and a flow control producing said second motor speed signal as a function of a full speed of the conveyor.

18. The apparatus of claim 17 wherein said motor speed controller further comprises a motor speed control causing said motor speed controller to provide said first motor speed signals in response to detecting a conveyor speed less than a full speed of the conveyor, and said second motor speed signal in response to detecting the full speed of the conveyor.

* * * * *